US008869707B2

(12) United States Patent
Kawauchi et al.

(10) Patent No.: US 8,869,707 B2
(45) Date of Patent: Oct. 28, 2014

(54) BRANCHING DEVICE AND TRACK TRANSPORTATION SYSTEM

(75) Inventors: Akihisa Kawauchi, Tokyo (JP); Hiroyuki Kono, Tokyo (JP); Yukihide Yanobu, Tokyo (JP); Yoshinobu Murakami, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 13/878,454

(22) PCT Filed: Feb. 22, 2012

(86) PCT No.: PCT/JP2012/054240

§ 371 (c)(1),
(2), (4) Date: Apr. 9, 2013

(87) PCT Pub. No.: WO2012/115134

PCT Pub. Date: Aug. 30, 2012

(65) Prior Publication Data

US 2013/0193277 A1 Aug. 1, 2013

(30) Foreign Application Priority Data

Feb. 23, 2011 (JP) ..... 2011-037243

(51) Int. Cl.

| | |
|---|---|
| ***B61C 11/00*** | (2006.01) |
| ***E01B 7/00*** | (2006.01) |
| ***B61B 13/04*** | (2006.01) |
| ***E01B 25/28*** | (2006.01) |

(52) U.S. Cl.

CPC . *E01B 7/00* (2013.01); *B61B 13/04* (2013.01); *E01B 25/28* (2013.01)

USPC ..... 105/72.2; 105/215.1; 105/215.2; 104/130.01

(58) Field of Classification Search

USPC ..... 104/130.01; 105/72.2, 215.1, 215.2; 8/130.01

See application file for complete search history.

(56) References Cited

U.S. PATENT DOCUMENTS 4,299,172 A * 11/1981 Dawson ..... 104/247
7,624,685 B2 * 12/2009 Andreasson et al. .... 104/130.07

(Continued)

FOREIGN PATENT DOCUMENTS

BE 668583 12/1965
CN 101490340 7/2009

(Continued)

OTHER PUBLICATIONS

International Search Report issued Apr. 17, 2012 in International (PCT) Application No. PCT/JP2012/054240.

(Continued)

*Primary Examiner* — Jason C Smith

(74) *Attorney, Agent, or Firm* — Wenderoth, Lind & Ponack, L.L.P.

(57) ABSTRACT

Provided is a branching device (D), which includes a branch line side guide rail (20*c*) that is disposed from a near side main line travel track (Ra) to a branch line travel track (Rc) at an inner side of these travel tracks, a main line side guide rail (10*b*) that is disposed from the near side main line travel track (Ra) to a far side main line travel track (Rb) at an outer side of these travel tracks, and a switching mechanism (40) that switches a position of a movable rail (25*c*) of the branch line side guide rail (20*c*) and a position of a movable rail (25*b*) of the main line side guide rail (20*b*) to a branch line guide position (BP) and a main line guide position (MP).

8 Claims, 8 Drawing Sheets

(56) References Cited

U.S. PATENT DOCUMENTS

| | | | | |
|---|---|---|---|---|
| 8,074,577 | B2 * | 12/2011 | Morichika et al. | 104/139 |
| 8,161,889 | B2 * | 4/2012 | Morichika et al. | 105/72.2 |
| 8,356,559 | B2 * | 1/2013 | Kurahashi et al. | 105/215.2 |
| 8,408,142 | B2 * | 4/2013 | Maeyama et al. | 104/245 |
| 8,561,547 | B2 * | 10/2013 | Shiroyama et al. | 105/215.2 |
| 2008/0083345 | A1 * | 4/2008 | Morita et al. | 104/106 |
| 2009/0259352 | A1 * | 10/2009 | Morichika et al. | 701/19 |
| 2009/0288575 | A1 * | 11/2009 | Morichika et al. | 104/139 |
| 2010/0100267 | A1 * | 4/2010 | Morichika et al. | 701/23 |
| 2011/0260009 | A1 * | 10/2011 | Vance et al. | 246/448 |
| 2011/0265683 | A1 * | 11/2011 | Kurahashi et al. | 105/215.2 |
| 2011/0271868 | A1 * | 11/2011 | Kurahashi et al. | 105/141 |
| 2012/0017800 | A1 * | 1/2012 | Kurahashi et al. | 105/182.1 |
| 2012/0031298 | A1 * | 2/2012 | Kurahashi et al. | 105/215.2 |
| 2013/0193277 | A1 * | 8/2013 | Kawauchi et al. | 246/415 R |
| 2013/0193278 | A1 * | 8/2013 | Yanobu et al. | 246/415 R |

FOREIGN PATENT DOCUMENTS

| | | |
|---|---|---|
| FR | 2 904 013 | 9/2008 |
| JP | 44-8773 | 4/1969 |
| JP | 59-154202 | 9/1984 |
| JP | 61-40801 | 9/1986 |
| JP | 2-209501 | 8/1990 |
| JP | 2-60801 | 12/1990 |
| JP | 2006-205945 | 8/2006 |
| WO | 01/44577 | 6/2001 |

OTHER PUBLICATIONS

Written Opinion of the International Searching Authority issued Apr. 17, 2012 in International (PCT) Application No. PCT/JP2012/054240.

Chinese Office Action issued Jun. 5, 2014 in corresponding Chinese Patent Application No. 201280003435.0 with partial English translation.

* cited by examiner

BRANCHING DEVICE AND TRACK TRANSPORTATION SYSTEM

FIELD OF THE INVENTION

The present invention relates to a branching device that leads a track vehicle, which is guided by and travels along a central guide rail disposed in the center of a travel track, to any one of a main line travel track and a branch line travel track branching off from the main line travel track, and a track transportation system having the same.

This application claims priority to and the benefits of Japanese Patent Application No. 2011-037243 filed on Feb. 23, 2011, the disclosure of which is incorporated herein by reference.

BACKGROUND ART

Recently, a new transportation system has attracted attention as an alternative transportation means to a bus or a train. As a type of such a new transportation system, a type that causes a vehicle having travel wheels made of rubber tires to travel along a central guide rail is known.

As a branching device of a track transportation system equipped with such a central guide rail, i.e. a central guide type track transportation system, for instance, a device disclosed in Patent Document 1 below is known.

Such a branching device is equipped with a travel track of a branch part that is a crossing portion of a main line and a branch line, a central guide rail disposed in the center of the travel track, and a switching mechanism integrally shifting the travel track and the central guide rail. This switching mechanism integrally shifts the travel track and the central guide rail between a position at which the travel track and the central guide rail are directed to a direction parallel to the main line and a position at which the travel track and the central guide rail are directed to a direction parallel to the branch line.

RELATED ART DOCUMENTS

[Patent Document 1] Japanese Unexamined Patent Application First Publication No. H02 (1990)-209501

DISCLOSURE OF THE INVENTION

Problems to be Solved by the Invention

In the branching device of the central guide type track transportation system as in the branching device set forth in Patent Document 1 above, even when only the central guide rail of the branch part is caused to be shifted in the direction parallel to the main line and the direction parallel to the branch line without shifting the travel track of the branch part, the central guide rail of the branch part crosses the travel track of the branch part, so that they interfere with each other. As such, the travel track of the branch part and the central guide rail of the branch part are caused to be integrally shifted. For this reason, in this type of branching device, the switching mechanism becomes large. Furthermore, energy consumption of the switching mechanism is also increased, and the initial cost and running cost are increased.

Accordingly, an object of the present invention is to provide a branching device capable of reducing an initial cost and a running cost and a central guide type track transportation system having the same.

Means for Solving the Problems

To accomplish the object, according to a first aspect of the present invention, a branching device, which leads a track vehicle, which is guided by and travels on a central guide rail disposed in the center of a travel track, to one of a main line travel track or a branch line travel track branching off from the main line travel track to one side, includes a switching mechanism, a near side central guide rail, a far side central guide rail, and a branch line central guide rail. The track vehicle includes central guide wheels that are allowed to be engaged with the central guide rail and a pair of branch guide wheels that are arranged in a vehicle width direction and are disposed at opposite sides of a vehicle body. The switching mechanism realizes a branch line side guide rail, a main line side guide rail, a branch line guide position, and a main line guide position. The branch line side guide rail is configured to be disposed from the main line travel track to the branch line travel track at one side of these travel tracks, and to cause the branch guide wheel of the one side of the track vehicle to be engaged to lead the track vehicle to the branch line travel track. The main line side guide rail is configured to, based on a branch starting position at which the branch line travel track begins to branch off from the main line travel track, to be disposed from the near side main line travel track, which is the main line travel track of near side of the branch starting position in the traveling-direction, to the far side main line travel track, which is a main line travel track of a traveling far side at the other side of the main line travel tracks, and to cause the branch guide wheel of the other side of the track vehicle to be engaged to lead the track vehicle to the far side main line travel track. The branch line guide position is a position at which the branch guide wheel of the one side is engaged with the branch line side guide rail and the branch guide wheel of the other side is not capable of being engaged with the main line side guide rail. The main line guide position is a position at which the branch guide wheel of the other side is engaged with the main line side guide rail and the branch guide wheel of the one side is not capable of being engaged with the branch line side guide rail. The near side central guide rail is the central guide rail of the near side main line travel track, and is configured so that, at a traveling-direction near side with respect to a portion at which a central position of a travel track width direction of the far side main line travel track crosses the branch line travel track, and a traveling far side with respect to the branch starting position is set as a traveling far side end. The far side central guide rail is the central guide rail of the far side main line travel track, and is configured so that a traveling far side with respect to a portion at which the central position of the travel track width direction of the far side main line travel track crosses the branch line travel track is set as a traveling near side end. The branch line central guide rail is the central guide rail of the branch line travel track, and is configured so that a traveling far side with respect to a portion at which the central position of the travel track width direction of the branch line travel track crosses the far side main line travel track is set as a traveling near side end.

The branching device can lead the track vehicle, which is traveling on the near side main line travel track, to the far side main line travel track using the main line side guide rail of the main line guide position, and lead the track vehicle, which is traveling on the near side main line travel track, to the branch line travel track using the branch line side guide rail of the branch line guide position.

For this reason, in the branching device, it is unnecessary to install the central guide rail on the portion at which the central position of the far side main line travel track in the travel track width direction intersects the branch line travel track or the portion at which the central position of the branch line travel track in the travel track width direction intersects the far side main line travel track, and the central guide rail is not installed on these portions. Accordingly, in the branching device, even when the travel track and the central guide rail are shifted in one body, interference between the central guide rail and the travel track can be avoided.

As described above, in the branching device, since the travel track need not be shifted, it is unnecessary to install a shiftable travel track. Furthermore, the switching mechanism can be made small, and the energy consumption of the switching mechanism can be reduced. As a result, according to the branching device, the initial cost and running cost thereof can be reduced.

According to a second aspect of the present invention, in the branching device, the switching mechanism shifts at least a part of each of the branch line side guide rail and the main line side guide rail to realize the branch line guide position and the main line guide position. Further, the switching mechanism may shift the pair of branch guide wheels in a vehicle width direction to achieve the branch line guide position and the main line guide position.

Further, according to a third aspect of the present invention, in the branching device, a distance between the traveling near side end of the far side central guide rail and the traveling near side end of the branch line central guide rail in the travel track width direction is a distance at which the travel wheels of the track vehicle travelling on the far side main line travel track cannot be in contact with the branch line central guide rail and at which the travel wheels of the track vehicle travelling on the branch line travel track cannot be in contact with the far side central guide rail.

In the branching device, the travel wheels of the track vehicle traveling on the far side main line travel track are not in contact with the branch line central guide rail, and the travel wheels of the track vehicle traveling on the branch line travel track are not in contact with the far side central guide rail. For this reason, the track vehicle can smoothly travel on the travel track within a branch part.

Further, according to a fourth aspect of the present invention, in the branching device, the track vehicle is configured so that the pair of branch guide wheels are disposed apart from the central guide wheels at intervals in a forward/backward direction of the vehicle body, and both a distance dimension between the traveling far side end of the near side central guide rail and the traveling near side end of the branch line side guide rail in a direction along the branch line travel track and a distance dimension between the traveling far side end of the near side central guide rail and the traveling near side end of the main line side guide rail in a direction along the far side main line travel track are greater than a dimension of the distance between the central guide wheels of the track vehicle and the pair of branch guide wheels.

In the branching device, when the track vehicle enters the branch part, the state in which both the branch guide wheels and the central guide wheels are engaged with the corresponding guide rails can be reliably secured. For this reason, the transition from the near side main line travel track of the track vehicle to the branch line travel track and the transition from the near side main line travel track to the far side main line travel track can be performed smoothly and reliably.

Further, according to a fifth aspect of the present invention, in the branching device, the track vehicle has the central guide wheels in each of the front and rear of the vehicle body, and both a distance dimension between the traveling far side end of the near side central guide rail and the traveling near side end of the far side central guide rail in a direction along the main line travel track and a distance dimension between the traveling far side end of the near side central guide rail and the traveling near side end of the branch line central guide rail in a direction along the branch line travel track are smaller than a distance dimension between the central guide wheels disposed in the front of the vehicle body and the central guide wheels disposed in the rear of the vehicle body.

In the branching device, at least one of the front central guide wheels and the rear central guide wheels can be engaged with one of the near side central guide rail and the far side central guide rail or one of the near side central guide rail and the branch line central guide rail. Accordingly, in the branching device, the possibility of derailment of the track vehicle at the branch part can be reduced.

Further, according to a sixth aspect of the present invention, in the branching device, the branch line side guide rail and the main line side guide rail each include a movable rail that is displaceable between the main line guide position and the branch line guide position, and an immovable rail that is immovable with respect to the travel track disposed at the traveling far side of the movable rail. The traveling far side end of the near side central guide rail is located at a traveling-direction near side with respect to a traveling far side end of the movable rail of the branch line side guide rail and a traveling far side end of the movable rail of the main line side guide rail.

In the branching device, when a drive source of the switching mechanism is disposed at one side of the travel track width direction based on the movable rail of the branch line side guide rail or the movable rail of the main line side guide rail, and the drive source and each movable rail are connected by a link, it is unnecessary to detour the link with respect to the near side central guide rail, so that the initial cost of the switching mechanism can be suppressed.

Further, according to a seventh aspect of the present invention, in the branching device, positions of a lower edge of the branch line side guide rail and a lower edge of the main line side guide rail are higher than a position of an upper edge of the central guide rail.

In the branching device, since a height of the branch guide wheel abutting the branch line side guide rail or the main line side guide rail becomes high, a possibility of the travel wheels coming into contact with the travel track when the travel wheels burst can be reduced. Further, in the branching device, interference between the branch guide wheel of the track vehicle that is traveling on the far side main line travel track and the branch line central guide rail, and between the branch guide wheel of the track vehicle that is traveling on the branch line travel track and the far side central guide rail can be avoided. For this reason, the track vehicle can smoothly travel on the far side main line travel track and the branch line travel track.

According to an eighth aspect of the present invention, a central guide type track transportation system includes the branching device and the track vehicle.

In the track transportation system, since the branching device is provided, an initial cost and running cost of the system can be reduced.

Effects of the Invention

According to the branching device of the present invention, the travel track need not be shifted, and it is unnecessary to install a shiftable travel track. Furthermore, the switching mechanism can be made small, and the energy consumption of the switching mechanism can be reduced.

Further, according to the track transportation system of the present invention, an initial cost and running cost of the branching device can be reduced.

MODE FOR CARRYING OUT THE INVENTION

Figure 1:
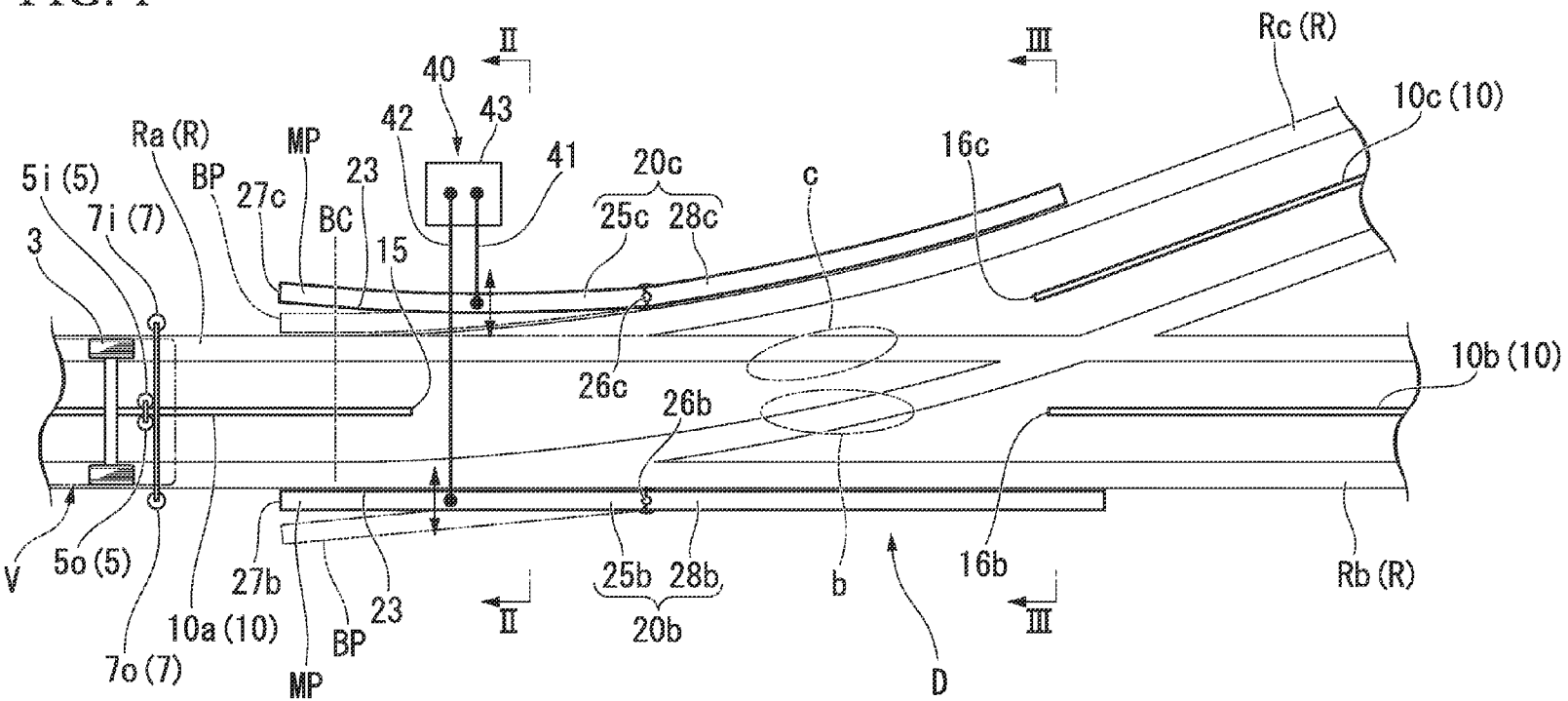
FIG. 1 is a plan view of a track transportation system according to an embodiment of the present invention.

Hereinafter, a track transportation system according to an embodiment of the present invention will be described in detail with reference to the drawings.

The track transportation system of the present embodiment is equipped with a central guide type travel facility in which a central guide rail is provided in the center of a travel track, and a track vehicle that travels on the travel track. Therefore, prior to the description of the travel facility of the present embodiment, the track vehicle that travels on the travel track of the travel facility will be described with reference to FIGS. 2 and 8 first.

The track vehicle V of the present embodiment includes a vehicle body 1, and travel apparatuses 2 installed in front of and behind a lower portion of the vehicle body 1.

The travel apparatuses 2 are each equipped with a pair of travel wheels 3 arranged in a vehicle width direction, an axle 4 mutually connecting the pair of travel wheels 3, a pair of central guide wheels 5 lined up in the vehicle width direction and disposed at a more inner side than the pair of travel wheels 3 in the vehicle width direction, a guide frame 6 rollably supporting the pair of central guide wheels 5, and a steering link mechanism 9 that supports the guide frame 6 so as to be able to pivot around a pivotal axis perpendicular to a floor surface of the vehicle body 1 at a central position of the vehicle body 1 in the vehicle width direction and steers the pair of travel wheels 3 in connection with the pivoting of the guide frame 6 around the pivotal axis.

Each travel apparatus 2 further includes a pair of branch guide wheels 7 lined up in the vehicle width direction and disposed on opposite sides of the vehicle body 1 and a guide rod 8 extending in the vehicle width direction and rollably supporting the pair of branch guide wheels 7.

Each travel wheel 3 is a tire whose outer circumferential portion is formed of rubber and whose interior is sealed with a gas.

Figure 8:
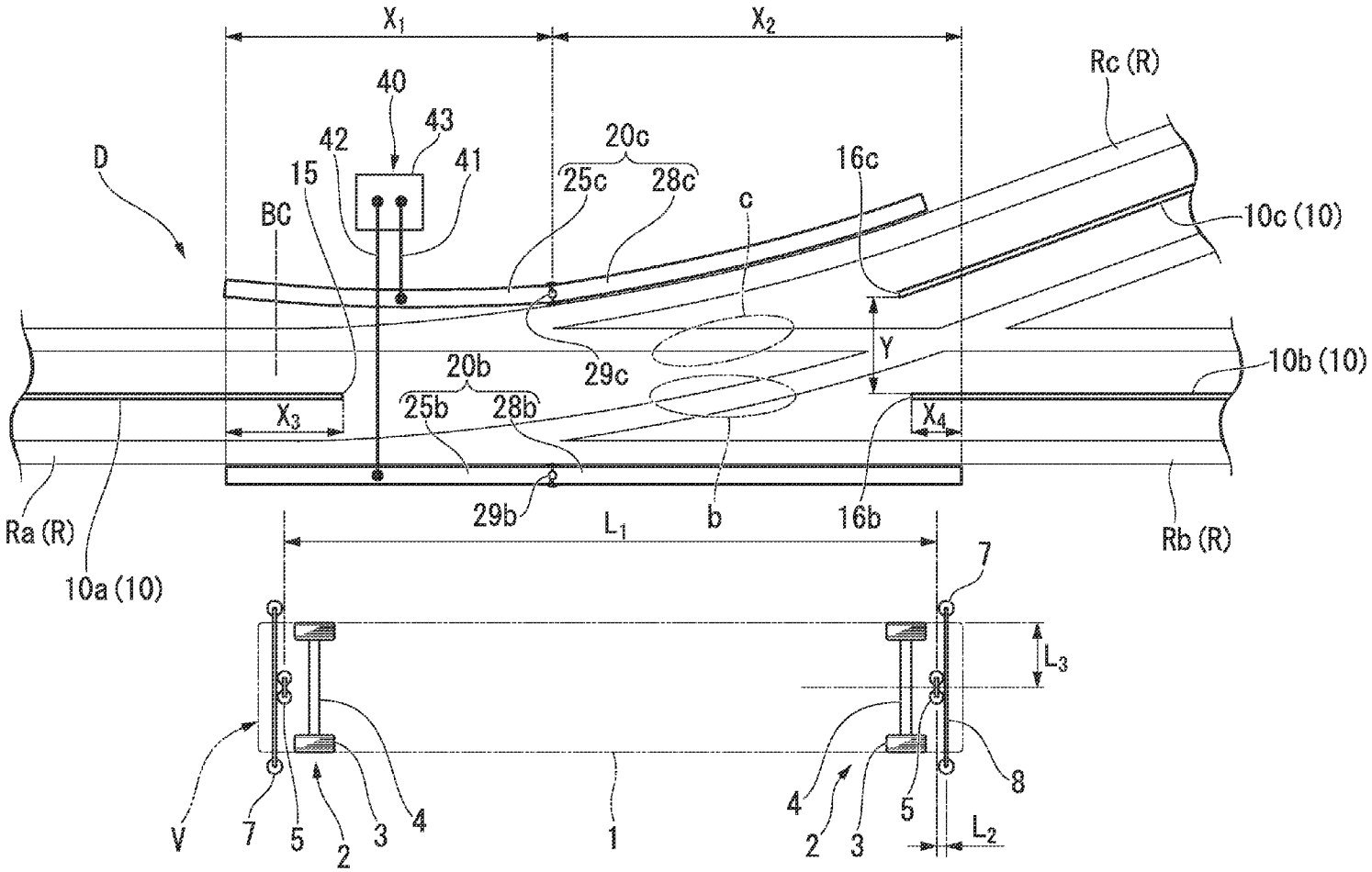
FIG. 8 is an explanatory view showing a layout or dimension relation of each rail of a branching device in the track transportation system according to the embodiment of the present invention.

The pair of branch guide wheels 7 is disposed at a more upper side than the pair of central guide wheels 5. Further, as shown in FIG. 8, the pair of branch guide wheels 7 in the front travel apparatus 2 are disposed at a more near side than the pair of central guide wheels 5, and the pair of branch guide wheels 7 in the rear traveling device 2 are disposed at a more rear side than the pair of central guide wheels 5. Outer circumferential portions of the branch guide wheels 7 and the central guide wheels 5 are formed of an elastic body such as urethane rubber.

The steering link mechanism 9 supports the guide frame 6 as well as the guide rod 8 so as to be able to be displaced in the vehicle width direction, and steers the pair of travel wheels 3 with the displacement of the guide rod 8 in the vehicle width direction. That is, the steering link mechanism 9 steers the pair of travel wheels 3 in response to the pivoting of the guide frame 6 on which the central guide wheels 5 are installed and the vehicle width direction displacement of the guide rod 8 on which the branch guide wheels 7 are installed.

Next, the travel facility of the present embodiment will be described.

As shown in FIG. 1, the travel facility of the present embodiment is equipped with a travel track R, a central guide rail 10 disposed in the center of the travel track R, and a branching device D.

The travel track R includes main line travel tracks Ra and Rb and a branch line travel track Rc branching off from the main line travel tracks Ra and Rb. Hereinafter, based on a branch starting position BC at which the branch line travel track Rc begins to branch off from the main line travel tracks Ra and Rb, the main line travel track Ra located at a near side in a traveling direction with respect to the branch starting position BC is defined as a near side main line travel track Ra, and the main line travel track Rb located at a far side in the traveling direction with respect to the branch starting position BC is defined as a far side main line travel track Rb. Further, based on the main line travel tracks Ra and Rb in the travel track width direction, a side at which the branch line travel track Rc extends is defined as an inner side, and the opposite side of the inner side is defined as an outer side.

The branching device D is a device that leads the track vehicle V on the near side main line travel track Ra to any one of the near side main line travel track Rb and the branch line travel track Rc.

Such a branching device D includes a branch line side guide rail 20*c* that is disposed from the near side main line travel track Ra to the branch line travel track Rc at the inner side of the travel tracks Ra and Rc, a main line side guide rail 20*b* that is disposed from the near side main line travel track Ra to the far side main line travel track Rb at the outer side of the travel tracks Ra and Rb, a switching mechanism 40 that changes a position of the branch line side guide rail 20*c* and a position of the main line side guide rail 20*b*, a near side central guide rail 10*a* that is the central guide rail 10 of the near side main line travel track Ra, a far side central guide rail 10*b* that is the central guide rail 10 of the far side main line travel track Rb, and a branch line central guide rail 10*c* that is the central guide rail 10 of the branch line travel track Rc.

The near side central guide rail 10*a* is configured so that, at a traveling-direction near side with respect to a portion b at which the central position of the far side main line travel track Rb in the travel track width direction crosses the branch line travel track Rc, a traveling far side with respect to the branch starting position BC is set as a traveling far side end 15. Further, the far side central guide rail 10*b* is configured so that, at a traveling far side with respect to the portion b at which the central position of the far side main line travel track Rb in the travel track width direction crosses the branch line travel track Rc, a traveling-direction near side with respect to a traveling far side end of the main line side guide rail 20*b* is set as a traveling near side end 16*b*. Further, the branch line central guide rail 10*c* is configured so that, at a traveling far side with respect to a portion c at which the central position of the branch line travel track Rc in the travel track width direction crosses the far side main line travel track Rb, a traveling-direction near side with respect to a traveling far side end of the branch line side guide rail 20*c* is set as a traveling near side end 16*c*.

The near side central guide rail 10*a* stands abreast with a traveling-direction near side portion of the main line side guide rail 20*b* in a direction along the travel track R. Further, the near side central guide rail 10*a* also stands abreast with a traveling-direction near side portion of the branch line side guide rail 20*c* in the direction parallel to the travel track R. A length dimension of the portion at which the near side central guide rail 10*a* and the main line side guide rail 20*b* stand side by side in the direction along the travel track R and a length dimension of the portion at which the near side central guide rail 10*a* and the branch line side guide rail 20*c* stands side by side in the direction along the travel track R are substantially the same in the present embodiment.

The far side central guide rail 10*b* stands abreast with a traveling near side portion of the main line side guide rail 20*b* in a direction along the far side main line travel track Rb. Further, the branch line central guide rail 10*c* stands abreast with a traveling far side portion of the branch line side guide rail 20*c* in a direction along the branch line travel track Rc.

Both the branch line side guide rail 20*c* and the main line side guide rail 20*b* include movable rails 25*c* and 25*b* that are able to be swung in a horizontal plane based on traveling far side ends 26*c* and 26*b* thereof, and immovable rails 28*c* and 28*b* that are disposed at a traveling far side of the movable rails 25*c* and 25*b* so as to continue with the movable rails 25*c* and 25*b* and are fixed relative to the travel track R.

The switching mechanism 40 is a device that, between a branch line guide position BP at which, of the pair of branch guide wheels 7, the inner branch guide wheel 7*i* is engaged with the movable rail 25*c* of the branch line side guide rail 20*c* (hereinafter referred to as "branch line movable rail 25*c*") and the outer branch guide wheel 7*o* cannot be engaged with the movable rail 25*b* of the main line side guide rail 20*b* (hereinafter referred to as "main line movable rail 25*b*") and a main line guide position MP at which the outer branch guide wheel 7*o* is engaged with the main line movable rails 25*b* and the inner branch guide wheel 7*i* cannot be engaged with the branch line movable rail 25*c*, switches positions of the branch line movable rail 25*c* and the main line movable rail 25*b*.

The switching mechanism 40 includes a driving machine 43 disposed at a more inner side than the branch line movable rail 25*c*, a first link 41 connecting the driving machine 43 and the branch line movable rail 25*c*, and a second link 42 connecting the driving machine 43 and the main line movable rail 25*b*. The driving machine 43 shifts the first link 41 in the travel track width direction, thereby swinging the branch line movable rail 25*c* connected to the first link 41 based on the traveling far side end 26*c* of the branch line movable rail 25*c* and switching the branch line movable rail 25*c* between the branch line guide position BP and the main line guide position MP. Further, the driving machine 43 shifts the second link 42 in the travel track width direction, thereby swinging the main line movable rail 25*b* connected to the second link 42 based on the traveling far side end 26*b* of the main line movable rail 25*b*, and switching the main line movable rail 25*b* between the branch line guide position BP and the main line guide position MP.

The driving machine 43 includes a drive source such as a hydraulic cylinder, an electromagnetic cylinder, or an electric motor. When the electric motor is used as the drive source, for example, a rack and pinion is used to convert rotational motion into linear motion of the electric motor.

Herein, although the driving machine 43 is disposed at the more inner side than the branch line movable rail 25*c*, the driving machine 43 may be disposed at a more outer side than the main line movable rail 25*b*. Further, although the driving machine 43 and the branch line movable rail 25*c* are connected by the first link 41 and the driving machine 43 and the main line movable rail 25*b* are connected by the second link 42, the branch line movable rail 25*c* and the main line movable rail 25*b* may be connected by one connecting link, and this connecting link and the driving machine 43 may be connected by a separate link.

Figure 2:
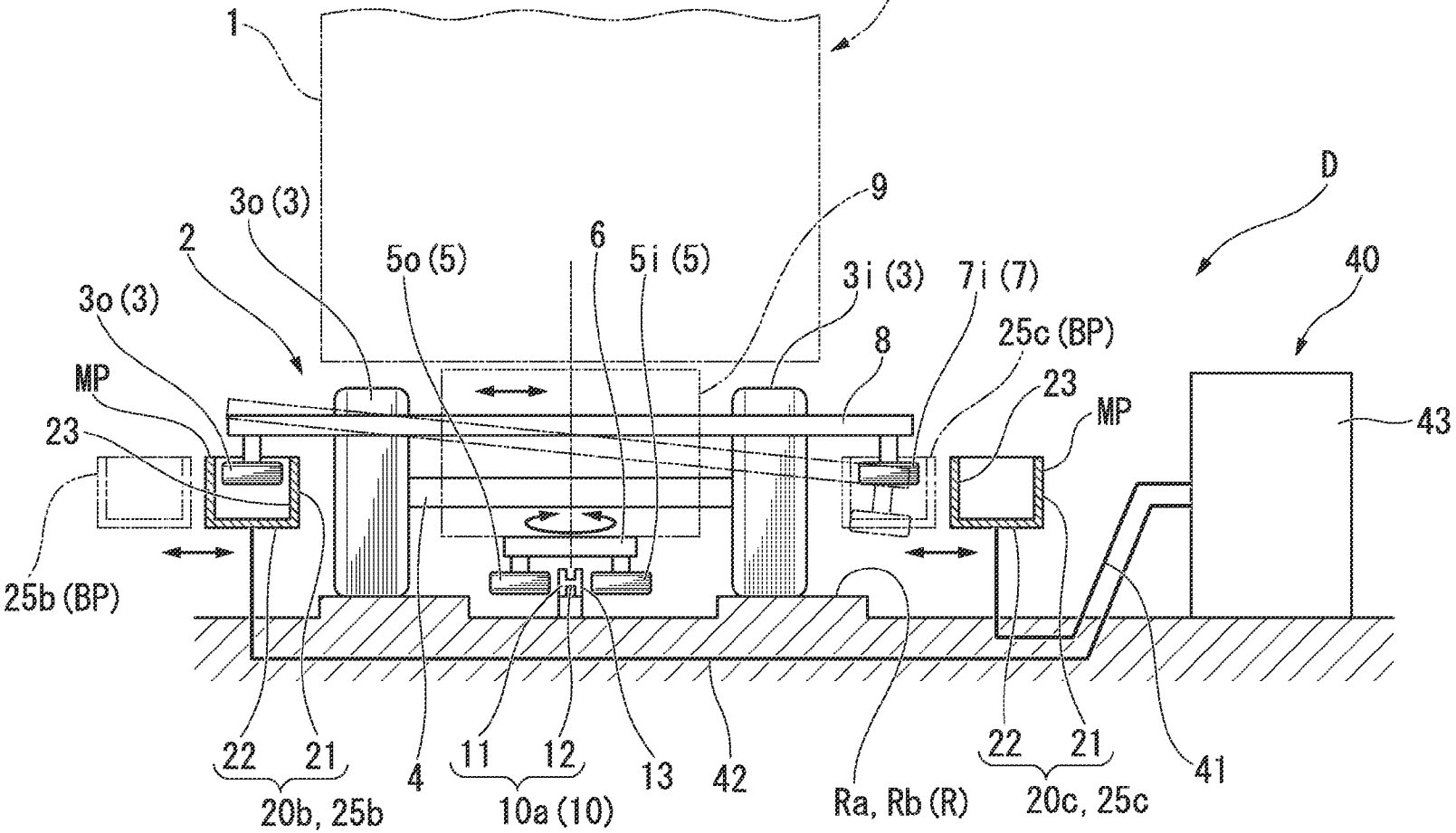
FIG. 2 is a cross-sectional view taken along line II-II of FIG. 1.

As shown in FIG. 2, the central guide rail 10 is formed of an H-steel. The H-steel is disposed so that a pair of flanges 11 parallel to each other is directed in a vertical direction and so that a web 12 connecting the pair of flanges 11 is directed in a horizontal direction. In the central guide rail 10 formed of the H-steel, outer faces of the pair of flanges 11, i.e. faces facing mutually opposite directions, form central guide faces 13, respectively. Herein, the H-steel is used as the central guide rail 10. However, any member, for instance an I-steel, may be used as long as it has a pair of faces that are parallel to each other and face opposite directions.

Both the branch line side guide rail 20*c* and the main line side guide rail 20*b* are formed of channel steel, i.e. the channel steel having a web 22 which is a rectangular plate and a pair of flanges 21 formed perpendicular to the web 22 along a pair of long sides of the web 22. The channel steel is disposed so that the pair of flanges 21 is directed in a vertical direction and so that the web 22 connecting the pair of flanges 21 is directed in a horizontal direction. The channel steel forms the branch line side guide rail 20*c* and the main line side guide rail 20*b*. In the branch line side guide rail 20*c* and the main line side guide rail 20*b* formed of the channel steel, inner faces of the pair of flanges 21, i.e. faces opposed to each other, form side guide faces 23, respectively. Herein, the channel steel is used as the branch line side guide rail 20*c* and the main line side guide rail 20*b*. However, any member may be used as long as it has faces capable of being formed into the side guide faces 23.

Herein, the pair of branch guide wheels 7 of the track vehicle V are installed at a height at which, even when one of the pair of travel wheels 3 bursts and thus a position of one branch guide wheel 7 is lowered (indicated by a phantom line in FIG. 2), the branch guide wheel 7 is unable to come into contact with a track surface of the travel track R. The branch line side guide rail 20*c* and the main line side guide rail 20*b* are installed at a position of such a height as to be able to be engaged with the branch guide wheels 7 of a height of a state in which the travel wheels 3 do not burst.

On the other hand, the pair of central guide wheels 5 of the track vehicle V is configured so that a mutual distance there between is shorter than a mutual distance between the pair of branch guide wheels 7. For this reason, even when one of the pair of travel wheels 3 bursts, an amount by which one of the central guide wheels 5 is lowered is smaller than an amount by which one of the branch guide wheels 7 is lowered. As such, even when the pair of central guide wheels 5 is installed at a position that is lower than that of the pair of branch guide wheels 7, the central guide wheels 5 do not come into contact with the track surface of the travel track R. Thus, in the present embodiment, the pair of central guide wheels 5 is installed at a lower position than the pair of branch guide wheels 7. For this reason, the central guide rail 10 is installed at a lower position than the branch line side guide rail 20*c* and the main line side guide rail 20*b*.

A positional relation in the vertical direction between the central guide rail 10 and the branch line side guide rail 20*c* and between the central guide rail 10 and the main line side guide rail 20*b* will be described in greater detail. The central guide rail 10 is installed so that a vertical position of an upper edge thereof is lower than that of a lower edge of the branch line side guide rail 20*c* and that of a lower edge of the main line side guide rail 20*b*. This is a countermeasure against the burst of the travel wheels 3 as described above, and also serves the following purpose.

Figure 3:
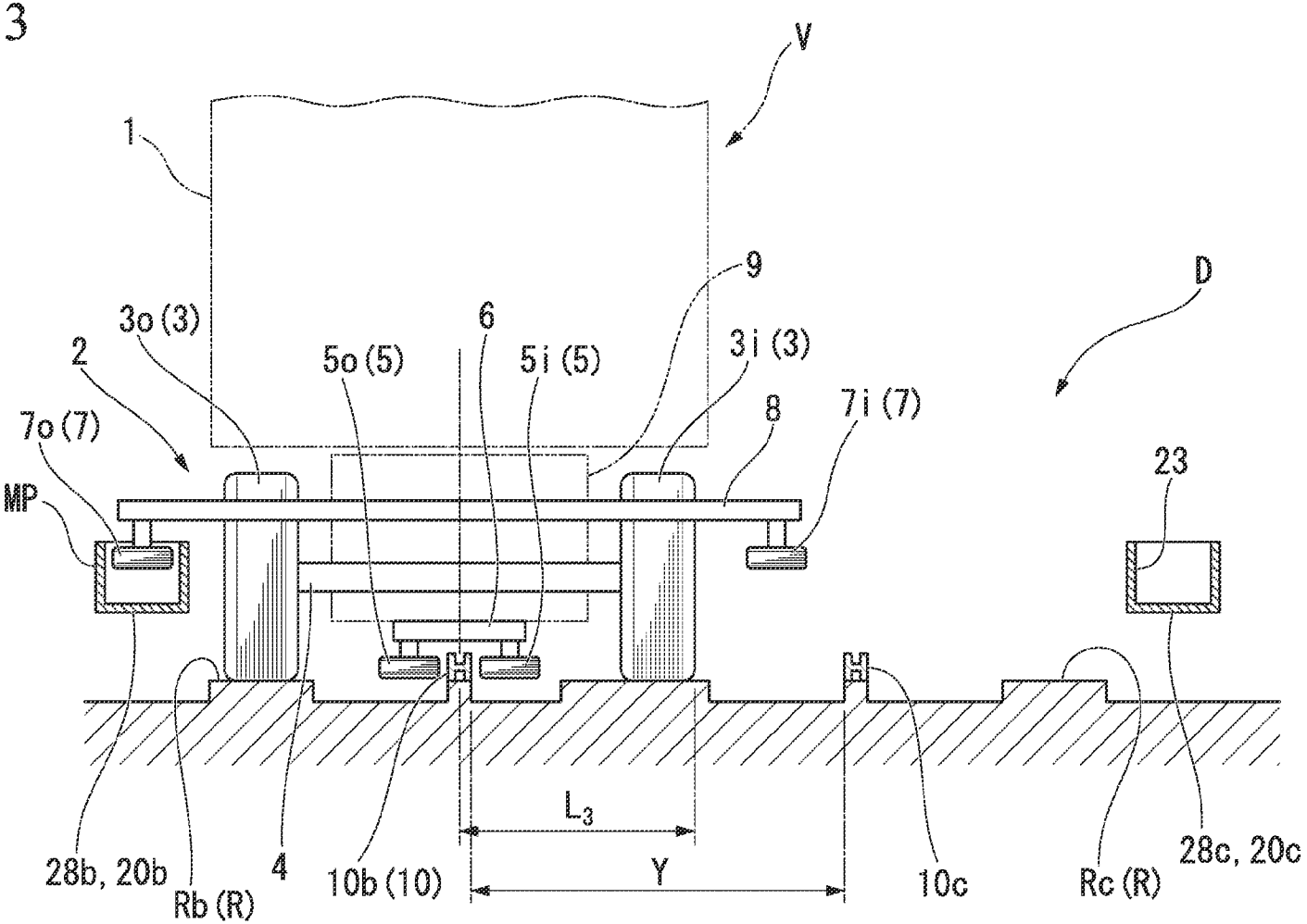
FIG. 3 is a cross-sectional view taken along line III-III of FIG. 1.
Figure 5:
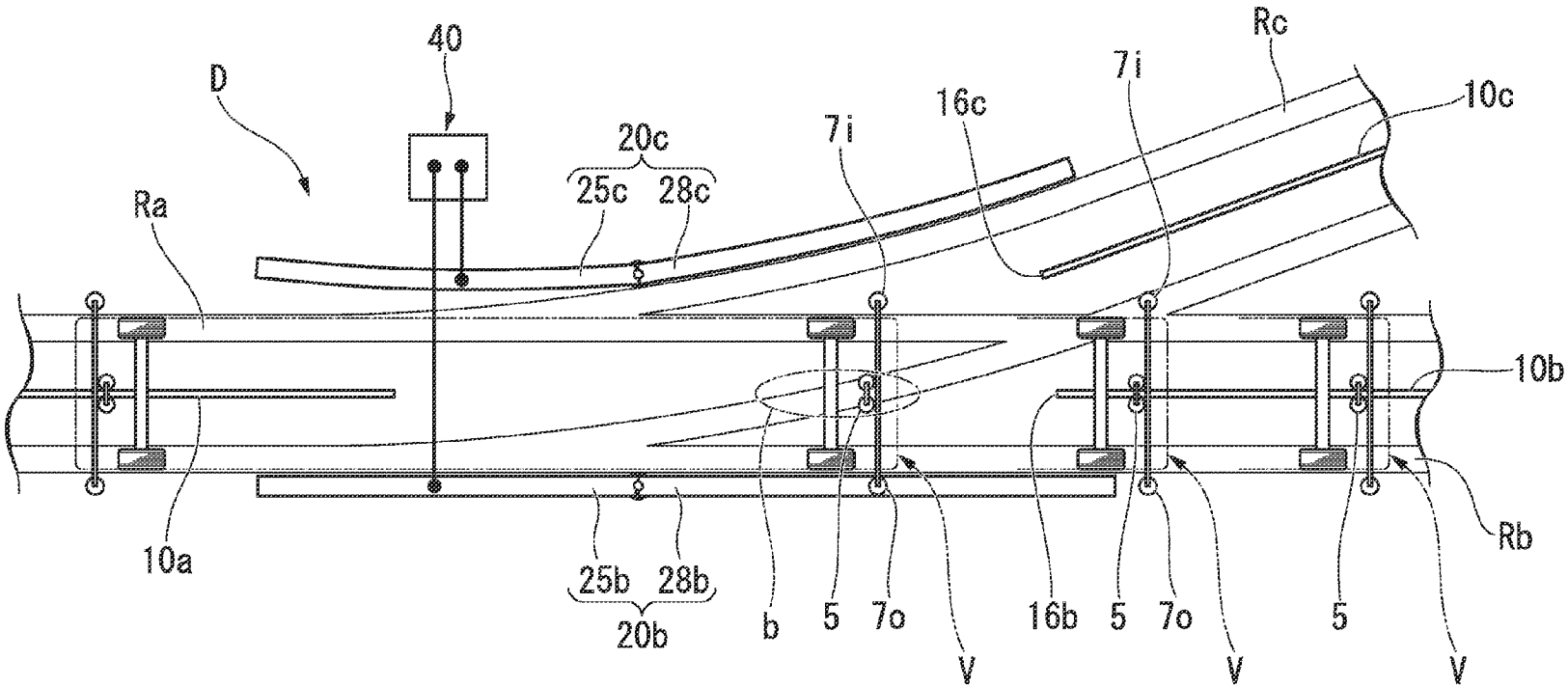
FIG. 5 is an explanatory view showing the state in which the track vehicle travels on the main line travel track in the track transportation system according to the embodiment of the present invention.

As shown in FIGS. 3 and 5, when the track vehicle V begins to travel on the near side main line travel track Rb and the central guide wheels 5 reach the traveling near side end 16*b* of the far side central guide rail 10*b*, the branch line central guide rail 10*c* is located at an inner side of the central guide wheels 5. In this case, if an upper edge of the branch line central guide rail 10*c* is provided at a higher position than a lower edge of the branch line side guide rail 20*c*, there is a possibility of the inner branch guide wheel 7*i* guided by the branch line side guide rail 20*c* interfering with the branch line central guide rail 10*c*. Therefore, to reliably avoid the interference between the inner branch guide wheel 7*i* and the branch line central guide rail 10*c*, a position of the upper edge of the branch line central guide rail 10*c* is made lower than that of the lower edge of the branch line side guide rail 20*c*. Further, when the track vehicle V begins to travel on the branch line travel track Rc and the central guide wheels 5 reach the traveling near side end 16*c* of the branch line central guide rail 10*c*, the far side central guide rail 10*b* is located at an outer side of the central guide wheels 5. Therefore, to remove a possibility of the outer branch guide wheel 7*o* guided by the main line side guide rail 20*b* interfering with the far side central guide rail 10*b*, a position of the upper edge of the far side central guide rail 10*b* is made lower than that of the lower edge of the main line side guide rail 20*b*.

The aforementioned positional relation between the branch line side guide rail 20*c* and the central guide rail 10 and between the main line side guide rail 20*b* and the central guide rail 10 is set in order to avoid interference between the branch guide wheels 7, which are guided by the branch line side guide rail 20*c* and the main line side guide rail 20*b*, and the central guide rail 10 in the vertical direction. For this reason, when the central guide rail 10 and the branch guide wheels 7 guided by the branch line side guide rail 20*c* and the main line side guide rail 20*b* do not interfere with each other in the horizontal direction, the above positional relation need not be met.

Next, an operation of the branching device D of the present embodiment and an operation of the track vehicle V associated with such an operation will be described.

First, an operation of the branching device D when the track vehicle V, which is traveling on the near side main line travel track Ra, is led to the far side main line travel track Rb, and an operation of the track vehicle V associated with such an operation will be described with reference to FIGS. 1 to 5.

When the track vehicle V, which is traveling on the near side main line travel track Ra, is led to the far side main line travel track Rb, the switching mechanism 40 of the branching device D causes the branch line movable rail 25*c* and the main line movable rail 25*b* to be located at the main line guide position MP.

As shown in FIGS. 1 and 2, the traveling near side end 27*c* of the branch line movable rail 25*c* at the main line guide position MP is located at a position at which it is separated from the near side main line travel track Ra toward the inner side. For this reason, the pair of side guide faces 23 of the branch line movable rail 25*c* is located at a position at which the inner branch guide wheel 7*i* of the pair of branch guide wheels 7 of the track vehicle V cannot be in contact therewith. That is, the branch line movable rail 25*c* is located at a position at which it cannot be engaged with the inner branch guide wheel 7*i*. Specifically, the pair of the side guide faces 23 of the branch line movable rail 25*c* are located at a more inner side than the inner branch guide wheel 7*i* of the track vehicle V that is traveling on the near side main line travel track Ra.

Further, the traveling near side end 27*b* of the main line movable rail 25*b* at the main line guide position MP is located at an outer side of the near side main line travel track Ra parallel to the near side main line travel track Ra. The pair of side guide faces 23 of the main line movable rail 25*b* is located at a position at which the outer branch guide wheel 7*o* of the pair of branch guide wheels 7 of the track vehicle V can be in contact therewith. That is, the main line movable rail 25*b* is located at a position at which the outer branch guide wheel 7*o* can be engaged therewith. Specifically, the side guide faces 23 of the main line movable rail 25*b* are located at opposite sides of the outer branch guide wheel 7*o* of the track vehicle V, which is traveling on the near side main line travel track Ra, in the travel track width direction. Further, the main line movable rail 25*b* at the main line guide position MP is directed in a direction along the far side main line travel track Rb.

Figure 4:
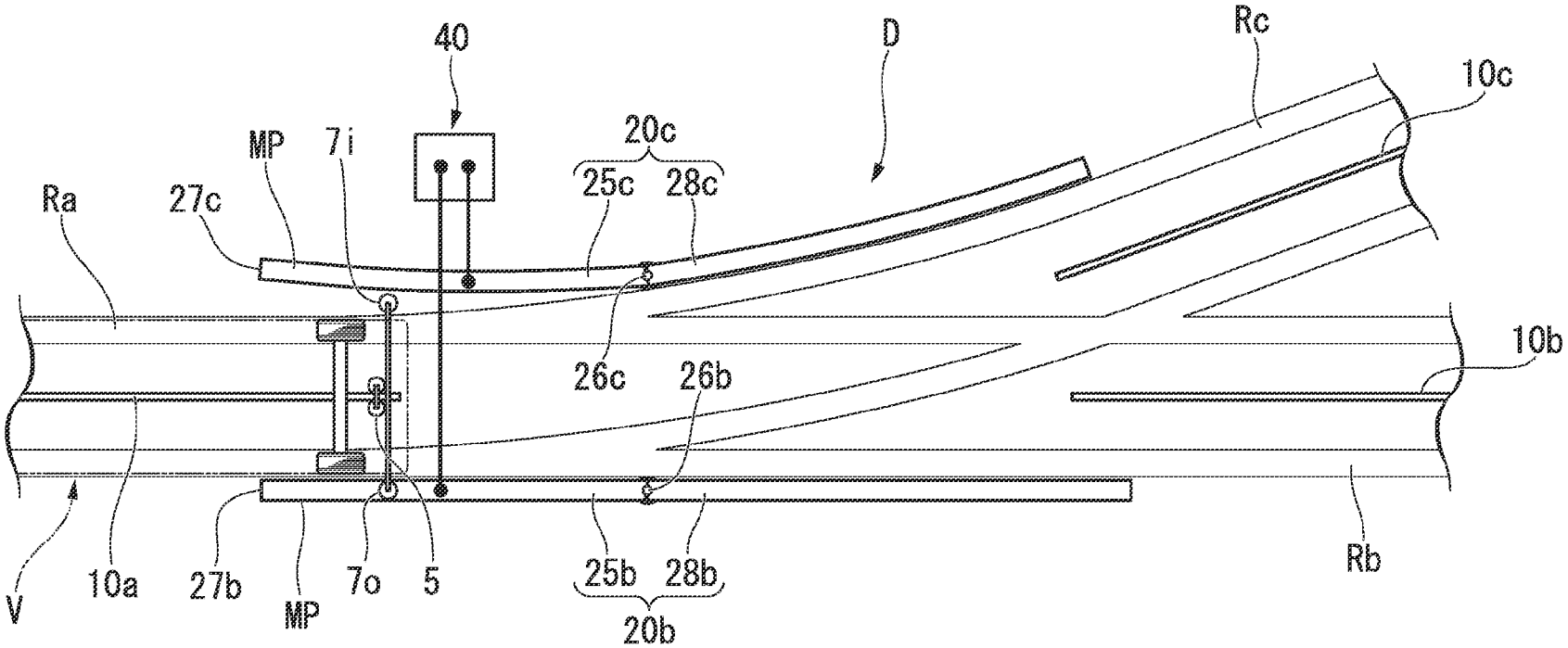
FIG. 4 is an explanatory view showing a state in which a track vehicle travels on a main line travel track in the track transportation system according to the embodiment of the present invention.

When the track vehicle V, which is traveling on the near side main line travel track Ra, is led by the near side central guide rail 10*a* and then reaches a position at which the branch line side guide rail 20*c* and the main line side guide rail 20*b* are installed, the outer branch guide wheel 7*o* of the track vehicle V is positioned between the pair of side guide faces 23 of the main line movable rail 25*b*, and is allowed to come into contact with any one of the pair of side guide faces 23. That is, the outer branch guide wheel 7*o* is kept engaged with the main line movable rail 25*b*. On the other hand, the inner branch guide wheel 7*i* of the track vehicle V is located at a more outer side than the pair of side guide faces 23 of the branch line movable rail 25*c*, and is not allowed to come into contact with either of the pair of side guide faces 23. For this reason, the outer branch guide wheel 7*o* is guided by the main line movable rail 25*b*. Accordingly, as shown in FIG. 4, the track vehicle V travels on the travel track, i.e. the far side main line travel track Rb, along a direction in which the main line movable rail 25*b* extends while the outer branch guide wheel 7*o* is guided by the main line movable rail 25*b*.

As shown in FIG. 5, when the outer branch guide wheel 7*o* of the track vehicle V is shifted from the main line movable rail 25*b* to the main line immovable rail 28*b* continuous with the main line movable rail 25*b*, the track vehicle V travels on the travel track, i.e. the far side main line travel track Rb, parallel to a direction in which the main line immovable rail 28*b* extends while being guided by the main line immovable rails 28*b*. When the outer branch guide wheel 7*o* of the track vehicle V reaches the traveling far side of the main line immovable rail 28*b*, a portion of the traveling-direction near side of the far side central guide rail 10*b* is located between the pair of central guide wheels 5 of the track vehicle V. That is, the pair of central guide wheels 5 are kept engaged with the far side central guide rail 10*b*. For this reason, the track vehicle V then travels on the far side main line travel track Rb while the pair of central guide wheels 5 are guided by the far side central guide rail 10*b*.

Incidentally, the track vehicle V is guided by the main line side guide rail 20*b* of the main line guide position MP, and then partly crosses the branch line travel track Rc in the process of travelling on the far side main line travel track Rb. However, since the branch line central guide rail 10*c* is not installed at a portion at which the central position of the branch line travel track Rc in the travel track width direction intersects the far side main line travel track Rb, the travel wheels 3 of the track vehicle V that is traveling on the far side main line travel track Rb travel on the far side main line travel track Rb without coming into contact with the branch line central guide rail 10*c*.

Next, an operation of the branching device D when the track vehicle V, which is traveling on the near side main line travel track Ra, is led to the branch line travel track Rc, and an operation of the track vehicle V associated with such an operation will be described with reference to FIGS. 1, 2, 6 and 7.

When the track vehicle V, which is traveling on the near side main line travel track Ra, is led to the branch line travel track Rc, the switching mechanism 40 of the branching device D causes the branch line movable rail 25*c* and the main line movable rail 25*b* to be located at the branch line guide position BP (indicated by a two-dot chain line as a phantom line in FIGS. 1 and 2).

As indicated in FIG. 1 by the phantom line, the traveling near side end 27*b* of the main line movable rail 25*b* at the branch line guide position BP is located at a position at which it is separated from the near side main line travel track Ra toward an outer side. For this reason, the pair of side guide faces 23 of the main line movable rail 25*b* is located at a position at which the outer branch guide wheel 7*o* of the track vehicle V cannot be in contact therewith. That is the main line movable rail 25*b* is located at a position at which the outer branch guide wheel 7*o* cannot be engaged therewith. Specifically, both of the side guide faces 23 of the main line movable rail 25*b* are located at a more outer side than the outer branch guide wheel 7*o* of the track vehicle V that is traveling on the near side main line travel track Ra.

Further, the traveling near side end 27*c* of the branch line movable rail 25*c* at the branch line guide position BP is located at an inner side of the near side main line travel track Ra along the near side main line travel track Ra. For this reason, the pair of side guide faces 23 of the branch line movable rail 25*c* is located at a position at which the inner branch guide wheel 7*i* of the track vehicle V can be in contact therewith. That is, the branch line movable rail 25*c* is located at a position at which the inner branch guide wheel 7*i* can be engaged therewith. Specifically, the side guide faces 23 of the branch line movable rail 25*c* are located at opposite sides of the inner branch guide wheel 7*i* of the track vehicle V that is traveling on the near side main line travel track Ra in the travel track width direction. Further, the branch line movable rail 25*c* at the branch line guide position BP is directed in a direction along the branch line travel track Rc.

Figure 6:
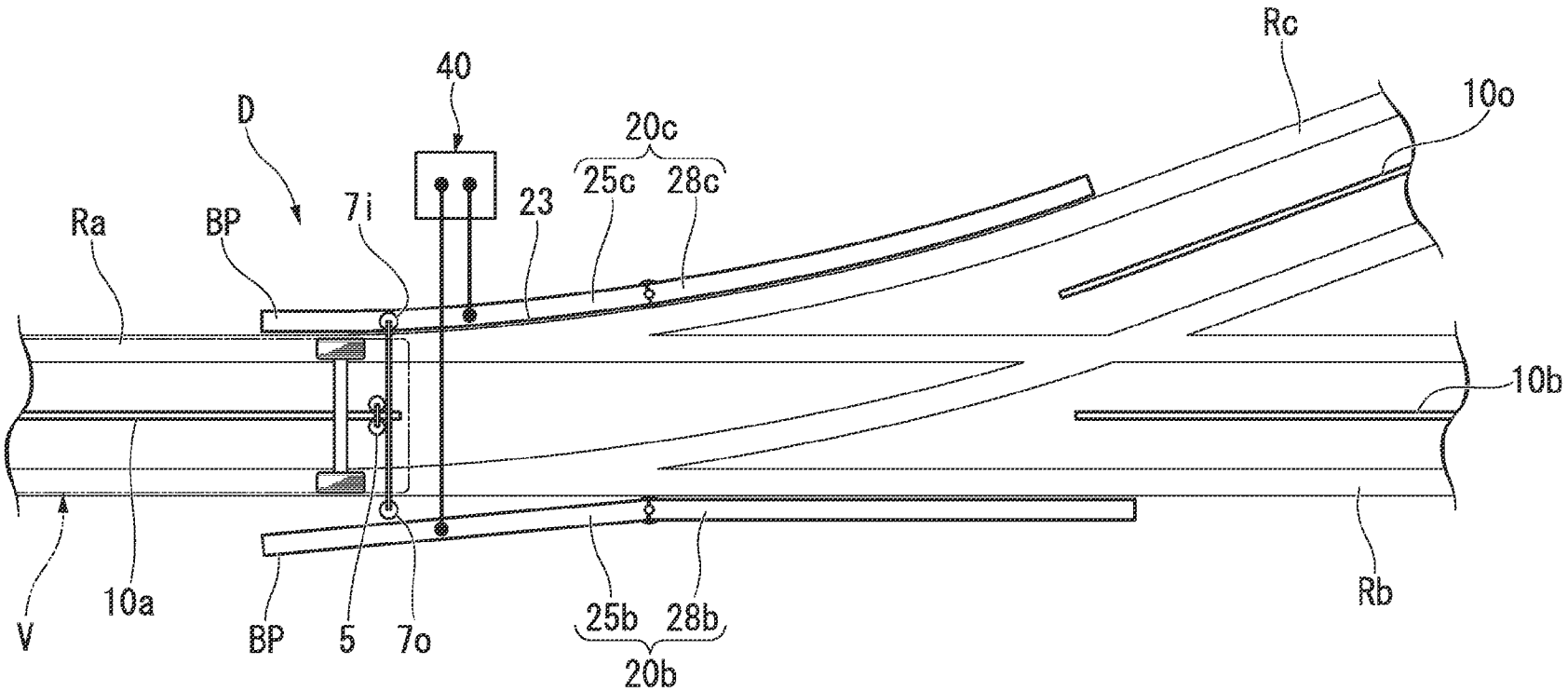
FIG. 6 is an explanatory view showing a state in which the track vehicle travels on a branch line travel track in the track transportation system according to the embodiment of the present invention.

When the track vehicle V, which is traveling on the near side main line travel track Ra, is led by the near side central guide rail 10*a* and then reaches a position at which the branch line side guide rail 20*c* and the main line side guide rail 20*b* are installed, the inner branch guide wheel 7*i* of the track vehicle V is positioned between the pair of side guide faces 23 of the branch line movable rail 25*c*, and is allowed to come into contact with any one of the pair of side guide faces 23. That is, the inner branch guide wheel 7*i* is kept engaged with the branch line movable rail 25*c*. On the other hand, the outer branch guide wheel 7*o* of the track vehicle V is located at a more inner side than the pair of side guide faces 23 of the main line movable rail 25*b*, and is not allowed to come into contact with either of the pair of side guide faces 23. For this reason, the inner branch guide wheel 7*i* is guided by the branch line movable rail 25*c*. Accordingly, as shown in FIG. 6, the track vehicle V travels on the travel track, i.e. the branch line travel track Rc, parallel to a direction in which the branch line movable rail 25*c* extends while the inner branch guide wheel 7*i* is guided by the branch line movable rail 25*c*.

Figure 7:
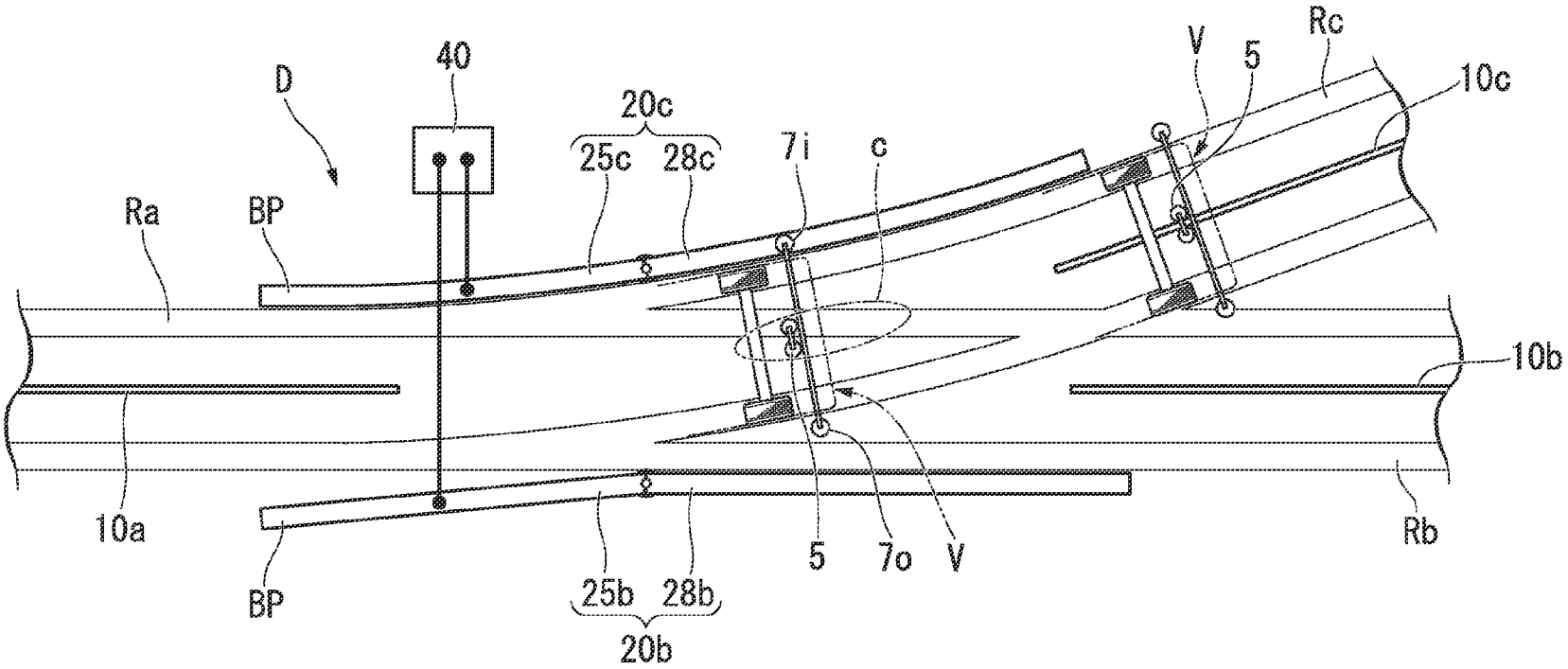
FIG. 7 is an explanatory view showing the state in which the track vehicle travels on the branch line travel track in the track transportation system according to the embodiment of the present invention.

As shown in FIG. 7, when the inner branch guide wheel 7*i* of the track vehicle V is shifted from the branch line movable rail 25*c* to the branch line immovable rail 28*c* continuous with the branch line movable rail 25*c*, the track vehicle V travels on the travel track, i.e. the branch line travel track Rc, along a direction in which the branch line immovable rail 28*c* extends while being guided by the branch line immovable rail 28*c*. When the inner branch guide wheel 7*i* of the track vehicle V reaches the traveling far side of the branch line immovable rail 28*c*, a portion of the traveling-direction near side of the branch line central guide rail 10*c* is positioned between the pair of central guide wheels 5 of the track vehicle V. That is, the pair of central guide wheels 5 are kept engaged with the branch line central guide rail 10*c*. For this reason, the track vehicle V travels on the branch line travel track Rc afterwards while the pair of central guide wheels 5 are guided by the branch line central guide rail 10*c*.

Incidentally, the track vehicle V is guided by the branch line side guide rail 20*c* of the branch line guide position BP, and partly crosses the far side main line travel track Rb in the process of traveling on the branch line travel track Rc.

However, since the far side central guide rail 10*b* is not installed at a portion c at which the central position of the far side main line travel track Rb in the travel track width direction intersects the branch line travel track Rc, the travel wheels 3 of the track vehicle V that is traveling on the branch line travel track Rc travel on the branch line travel track Rc without coming into contact with the far side central guide rail 10*b*.

So far, in the present embodiment, the track vehicle V, which is traveling on the near side main line travel track Ra, is led to the far side main line travel track Rb by the main line side guide rail 20*b* of the main line guide position MP, and the track vehicle V, which is traveling on the near side main line travel track Ra, is led to the branch line travel track Rc by the branch line side guide rail 20*c* of the branch line guide position BP.

Further, in the present embodiment, as described above, track vehicle V is led to the far side main line travel track Rb or the branch line travel track Rc by the main line side guide rail 20*b* or the branch line side guide rail 20*c*. For this reason, the central guide rail 10 need not be installed at the portion b at which the central position of the far side main line travel track Rb in the travel track width direction intersects the branch line travel track Rc or at the portion c at which the central position of the branch line travel track Rc in the travel track width direction intersects the far side main line travel track Rb, and the central guide rail 10 is not installed at these portions. For this reason, in the present embodiment, as in the related art, even when the travel track and the central guide rail are not shifted in one body at the traveling far side with respect to the branch starting position BC, interference between the far side central guide rail 10*b* and the branch line travel track Rc, and between the branch line central guide rail 10*c* and the far side main line travel track Rb can be avoided.

As described above, in the present embodiment, since it is unnecessary to shift the travel track R, there is no need to install a shiftable travel track R. Furthermore, the switching mechanism 40 can be made small, and the energy consumption of the switching mechanism 40 can be reduced. As a result, in the present embodiment, the initial cost and running cost of the branching device D can be reduced.

Next, a layout and dimensional relation of each rail will be described.

As shown in FIG. 8, length dimensions of the branch line movable rail 25*c* and the main line movable rail 25*b* in the direction along the travel track are defined as $X_1$. Further, length dimensions of the branch line immovable rail 28*c* and the main line immovable rail 28*b* in the direction along the travel track are defined as $X_2$.

Also, length dimensions of a portion at which the near side central guide rail 10*a* and the main line side guide rail 20*b* stand side by side and a portion at which the near side central guide rail 10*a* and the branch line side guide rail 20*c* stand side by side in the direction along the travel track are defined as $X_3$.

Further, length dimensions of a portion at which the far side central guide rail 10*b* and the main line side guide rail 20*b* stand side by side and a portion at which the branch line central guide rail 10*c* and the branch line side guide rail 20*c* stand side by side based on the direction along the travel track are defined as $X_4$.

Further, a distance dimension between the traveling near side end 16*c* of the branch line central guide rail 10*c* and the traveling near side end 16*b* of the far side central guide rail 10*b* based on the travel track width direction is defined as Y.

Furthermore, a distance dimension between the central guide wheels 5 of the front travel apparatus 2 and the central guide wheels 5 of the rear travel apparatus 2 in the forward/backward direction is defined as $L_1$. Further, a distance dimension between the central guide wheels 5 and the branch guide wheels 7 of each travel apparatus 2 in the forward/backward direction is defined as $L_2$. In addition, the distance dimension between a central position of the axle 4 and an outer edge of the travel wheel 3 based on the vehicle width direction is defined as $L_3$.

The branching device D of the present embodiment meets the following conditions (1) to (3).

$$L_3<Y \tag{1}$$

This condition (1) means that the distance dimension Y between the traveling near side end 16*c* of the branch line central guide rail 10*c* and the traveling near side end 16*b* of the far side central guide rail 10*b* in the travel track width direction is greater than the distance dimension $L_3$ between the central position of the axle 4 and the outer edge of the travel wheel 3 in the vehicle width direction.

As shown in FIG. 3, the travel wheels 3*i* of the inner side of the track vehicle V that is traveling on the far side main line travel track Rb can avoid coming into contact with the branch line central guide rail 10*c* by meeting the condition (1). Moreover, the travel wheels 3*o* of the outer side of the track vehicle V that is traveling on the branch line travel track Rc can avoid coming into contact with the far side central guide rail 10*b*. For this reason, smooth traveling of the track vehicle V can be realized. When the inner travel wheels 3*i* of the track vehicle V that is traveling on the far side main line travel track Rb have a possibility of coming into contact with the branch line central guide rail 10*c* or when the outer travel wheels 3*o* of the track vehicle V that is traveling on the branch line travel track Rc have a possibility of coming into contact with the far side central guide rail 10*b*, it is preferable that the position of the traveling near side end 16*c* of the branch line central guide rail 10*c* and the position of the traveling near side end 16*b* of the far side central guide rail 10*b* are shifted to the traveling far side and the distance dimension Y between the traveling near side ends 16*b* and 16*c* based on the travel track width direction is increased.

$$L_2<X_3 \text{ and } L_2<X_4 \tag{2}$$

The condition (2) means that the length dimension $X_3$ of the portion at which the near side central guide rail 10*a* and the main line side guide rail 20*b* stand side by side and the length dimension $X_3$ of the portion at which the near side central guide rail 10*a* and the branch line side guide rail 20*c* stand side by side are greater than the distance dimension $L_2$ between the central guide wheels 5 and the branch guide wheels 7 of the travel apparatus 2 based on the forward/backward direction. Furthermore, the length dimension $X_4$ of the portion at which the far side central guide rail 10*b* and the main line side guide rail 20*b* stand side by side and the length dimension $X_4$ of the portion at which the far side central guide rail 10*b* and the branch line side guide rail 20*c* stand side by side are greater than the distance dimension $L_2$.

By meeting the condition (2), when the front travel apparatus 2 enters the branch part, the state in which both the branch guide wheels 7 and the central guide wheels 5 are engaged with the corresponding guide rails can be reliably secured. For this reason, the transition of the track vehicle V from the near side main line travel track Ra to the branch line travel track Rc and the transition from the near side main line travel track Ra to the far side main line travel track Rb can be performed smoothly and reliably.

$$X_1>X_3 \text{ and } X_2>X_4 \tag{3}$$

The condition (3) means that the length dimensions $X_1$ of the branch line movable rail 25*c* and the main line movable rail 25*b* in the direction along the travel track are greater than the length dimensions $X_3$ of the portion at which the near side central guide rail 10*a* and the main line side guide rail 20*b* stand side by side in a direction along the travel track R and the portion at which the near side central guide rail 10*a* and the branch line side guide rail 20*c* stand side by side By meeting the condition (3), the distance between the traveling far side end 15 of the near side central guide rail 10*a* and the traveling near side end 29*c* of the branch line immovable rail 28*c*, and between the traveling far side end 15 of the near side central guide rail 10*a* and the traveling near side end 29*b* of the main line immovable rail 28*b* can be secured in the direction along the travel track R. For this reason, when viewed from the top, the interference between the near side central guide rail 10*a* and the second link 42 of the switching mechanism 40 can be avoided.

Further, the following condition (4) is preferably met.

$$L_1>(X_1+X_2)-(X_3+X_4) \tag{4}$$

Here, "$(X_1+X_2)-(X_3+X_4)$" is either a length dimension of a section at which the central guide rail 10 is not installed within a section at which the main line side guide rail 20*b* is installed in the direction along the far side main line travel track Rb, or a length dimension of a section at which the central guide rail 10 is not present within a section at which the branch line side guide rail 20*c* is present in the direction along the branch line travel track Rc. The condition (4) means that the length dimensions of the sections are smaller than the distance dimension $L_1$ between the central guide wheels 5 of the front travel apparatus 2 and the central guide wheels 5 of the rear travel apparatus 2 in the forward/backward direction.

By meeting the condition (4), at least one of the central guide wheels 5 of the front travel apparatus 2 and the central guide wheels 5 of the rear travel apparatus 2 can be engaged with one of the near side central guide rail 10*a* and the far side central guide rail 10*b* or one of the near side central guide rail 10*a* and the branch line central guide rail 10*c*. Accordingly, by meeting the condition (4), a possibility of the track vehicle V, which is traveling on the travel track R, being derailed at the branch part can be reduced. Further, in the present embodiment, when only the central guide wheels 5 of one of the front travel apparatus 2 and the rear travel apparatus 2 are engaged with the central guide rail 10, the branch guide wheels 7 of the other travel apparatus 2 are engaged with the branch line side guide rail 20*c* or the main line side guide rail 20*b*. Here, the branch part in the present embodiment is a region at which the branch line side guide rail 20*c* is present and a region at which the main line side guide rail 20*b* is present, within all the travel tracks Ra, Rb, and Rc in the direction along each of the travel tracks Ra, Rb, and Rc.

So far, in the present embodiment, the smooth traveling (avoidance of the interference between the tire and the guide rail) at the branch part is realized by the condition (1). Further, the possibility of derailment at the branch part is reduced by the condition (2). Further, in the present embodiment, by meeting the condition (3), it is unnecessary to detour the second link 42 of the switching mechanism 40 with respect to the near side central guide rail 10*a*, and the initial cost of the switching mechanism 40 can be suppressed. Further, if the condition (4) is also met, the possibility of derailment can be further reduced, which is more favorable.

Further, in the present embodiment, as described above, it is unnecessary to shift the travel track R of the branch part, and the initial cost and running cost of the branching device D can be reduced.

In the above embodiment, the branch line side guide rail 20*c* and the main line side guide rail 20*b* are shifted, thereby realizing the main line guide position MP and the branch line guide position BP. However, the entire branch line side guide rail 20*c* and the entire main line side guide rail 20*b* are immovable relative to the travel track R, and the pair of branch guide wheels 7 is shifted. Thereby, the main line guide position MP and the branch line guide position BP may be realized. In this case, in the vicinity of the branch part, a link relation between the guide rod 8 on which the pair of branch guide wheels 7 are installed and the travel wheels 3 is released, and directly in front of the branch part, the branch guide wheel 7 is located at one of the branch line guide position BP at which it can be engaged with the branch line side guide rail 20*c* and the main line guide position MP at which it can be engaged with the main line side guide rail 20*b* by the switching mechanism installed on the track vehicle V, and then the link relation between the guide rod 8 and the travel wheels 3 is restored.

INDUSTRIAL APPLICABILITY

According to the present invention, it is unnecessary to shift the travel track and to install the shiftable travel track. Furthermore, the switching mechanism can be made small, and thereby the energy consumption of the switching mechanism can be reduced.

DESCRIPTION OF REFERENCE NUMERALS

5 . . . central guide wheel
7 . . . branch guide wheel
10 . . . central guide rail
10*a* . . . near side central guide rail
10*b* . . . far side central guide rail
10*c* . . . branch line central guide rail
15 . . . traveling far side end (of near side central guide rail)
16*b* . . . traveling near side end (of far side central guide rail)
16*c* . . . traveling near side end (of branch line central guide rail)
20*b* . . . main line side guide rail
20*c* . . . branch line side guide rail
25*b* . . . movable rail (main line movable rail) (of main line side guide rail)
25*c* . . . movable rail (branch line movable rail) (of branch line side guide rail)
28*b* . . . immovable rail (main line immovable rail) (of main line side guide rail)
28*c* . . . immovable rail (branch line immovable rail) (of branch line side guide rail)
40 . . . switching mechanism
BC . . . branch starting position
D . . . branching device
BP . . . branch line guide position
MP . . . main line guide position
R . . . travel track
Ra . . . near side main line travel track
Rb . . . far side main line travel track
Rc . . . branch line travel track
V . . . track vehicle

The invention claimed is:

1. A branching device that leads a track vehicle, which is guided by a central guide rail disposed in the center of a travel track and travels, to one of a main line travel track or a branch line travel track branching off from the main line travel track, wherein the track vehicle includes central guide wheels that are allowed to be engaged with the central guide rail and a pair of branch guide wheels that are arranged side by side in a vehicle width direction and are disposed at both sides of a vehicle body, the branching device comprising:

a branch line side guide rail which is disposed from the main line travel track to the branch line travel track at one side of these travel tracks, and with which the branch guide wheel of the one side of the track vehicle is engaged to lead the track vehicle to the branch line travel track;

a main line side guide rail which, based on a branch starting position at which the branch line travel track begins to branch off from the main line travel track, is disposed from a near side main line travel track, which is the main line travel track of a traveling-direction near side of the branch starting position, to the far side main line travel track, which is the main line travel track of a traveling far side, at the other side of the main line travel tracks, and with which the branch guide wheel of the other side of the track vehicle is engaged to lead the track vehicle to the far side main line travel track;

a switching mechanism that realizes a branch line guide position at which the branch guide wheel of the one side is engaged with the branch line side guide rail and the branch guide wheel of the other side is unable to be engaged with the main line side guide rail, and a main line guide position at which the branch guide wheel of the other side is engaged with the main line side guide rail and the branch guide wheel of the one side is unable to be engaged with the branch line side guide rail;

a near side central guide rail which is the central guide rail of the near side main line travel track, and which is configured so that, at a traveling-direction near side with respect to a portion at which a central position of the far side main line travel track in a travel track width direction crosses the branch line travel track, and a traveling far side with respect to the branch starting position is set as a traveling far side end;

a far side central guide rail which is the central guide rail of the far side main line travel track, and which is configured so that a traveling far side with respect to a portion at which the central position of the far side main line travel track in the travel track width direction crosses the branch line travel track is set as a traveling near side end; and a branch line central guide rail which is the central guide rail of the branch line travel track, and which is configured so that a traveling far side with respect to a portion at which the central position of the branch line travel track in the travel track width direction crosses the far side main line travel track is set as a traveling near side end, wherein positions of a lower edge of the branch line side guide rail and a lower edge of the main line side guide rail are higher than a position of an upper edge of the central guide rail.

2. The branching device according to claim 1, wherein the switching mechanism shifts at least a part of each of the branch line side guide rail and the main line side guide rail to realize the branch line guide position and the main line guide position.

3. The branching device according to claim 2, wherein a distance between the traveling near side end of the far side central guide rail and the traveling near side end of the branch line central guide rail in the travel track width direction is a distance at which the travel wheels of the track vehicle travelling on the far side main line travel track are unable to be in contact with the branch line central guide rail and at which the travel wheels of the track vehicle travelling on the branch line travel track are unable to be in contact with the far side central guide rail.

4. The branching device according to claim 1, wherein a distance between the traveling near side end of the far side central guide rail and the traveling near side end of the branch line central guide rail in the travel track width direction is a distance at which the travel wheels of the track vehicle travelling on the far side main line travel track are unable to be in contact with the branch line central guide rail and at which the travel wheels of the track vehicle travelling on the branch line travel track are unable to be in contact with the far side central guide rail.

5. The branching device according to claim 1, wherein:

the branch line side guide rail and the main line side guide rail each include a movable rail that is displaceable between the main line guide position and the branch line guide position, and an immovable rail that is immovable relative to the travel track disposed at the traveling far side of the movable rail; and the traveling far side end of the near side central guide rail is located at a traveling-direction near side with respect to a traveling far side end of the movable rail of the branch line side guide rail and a traveling far side end of the movable rail of the main line side guide rail.

6. A track transportation system having the branching device according to claim 1 and the track vehicle.

7. A branching device that leads a track vehicle, which is guided by a central guide rail disposed in the center of a travel track and travels, to one of a main line travel track or a branch line travel track branching off from the main line travel track, wherein the track vehicle includes central guide wheels that are allowed to be engaged with the central guide rail and a pair of branch guide wheels that are arranged side by side in a vehicle width direction and are disposed at both sides of a vehicle body, the branching device comprising:

a branch line side guide rail which is disposed from the main line travel track to the branch line travel track at one side of these travel tracks, and with which the branch guide wheel of the one side of the track vehicle is engaged to lead the track vehicle to the branch line travel track;

a main line side guide rail which, based on a branch starting position at which the branch line travel track begins to branch off from the main line travel track, is disposed from a near side main line travel track, which is the main line travel track of a traveling-direction near side of the branch starting position, to the far side main line travel track, which is the main line travel track of a traveling far side, at the other side of the main line travel tracks, and with which the branch guide wheel of the other side of the track vehicle is engaged to lead the track vehicle to the far side main line travel track;

a switching mechanism that realizes a branch line guide position at which the branch guide wheel of the one side is engaged with the branch line side guide rail and the branch guide wheel of the other side is unable to be engaged with the main line side guide rail, and a main line guide position at which the branch guide wheel of the other side is engaged with the main line side guide rail and the branch guide wheel of the one side is unable to be engaged with the branch line side guide rail;

a near side central guide rail which is the central guide rail of the near side main line travel track, and which is configured so that, at a traveling-direction near side with respect to a portion at which a central position of the far side main line travel track in a travel track width direction crosses the branch line travel track, and a traveling far side with respect to the branch starting position is set as a traveling far side end;

a far side central guide rail which is the central guide rail of the far side main line travel track, and which is configured so that a traveling far side with respect to a portion at which the central position of the far side main line travel track in the travel track width direction crosses the branch line travel track is set as a traveling near side end; and a branch line central guide rail which is the central guide rail of the branch line travel track, and which is configured so that a traveling far side with respect to a portion at which the central position of the branch line travel track in the travel track width direction crosses the far side main line travel track is set as a traveling near side end, wherein:

the track vehicle is configured so that the pair of branch guide wheels are disposed apart from the central guide wheels at intervals in a forward/backward direction of the vehicle body; and both a distance dimension between the traveling far side end of the near side central guide rail and the traveling near side end of the branch line side guide rail in a direction along the branch line travel track, and a distance dimension between the traveling far side end of the near side central guide rail and the traveling near side end of the main line side guide rail in a direction along the far side main line travel track, are greater than a dimension of the distance between the central guide wheels of the track vehicle and the pair of branch guide wheels.

8. A branching device that leads a track vehicle, which is guided by a central guide rail disposed in the center of a travel track and travels, to one of a main line travel track or a branch line travel track branching off from the main line travel track, wherein the track vehicle includes central guide wheels that are allowed to be engaged with the central guide rail and a pair of branch guide wheels that are arranged side by side in a vehicle width direction and are disposed at both sides of a vehicle body, the branching device comprising:

a branch line side guide rail which is disposed from the main line travel track to the branch line travel track at one side of these travel tracks, and with which the branch guide wheel of the one side of the track vehicle is engaged to lead the track vehicle to the branch line travel track;

a main line side guide rail which, based on a branch starting position at which the branch line travel track begins to branch off from the main line travel track, is disposed from a near side main line travel track, which is the main line travel track of a traveling-direction near side of the branch starting position, to the far side main line travel track, which is the main line travel track of a traveling far side, at the other side of the main line travel tracks, and with which the branch guide wheel of the other side of the track vehicle is engaged to lead the track vehicle to the far side main line travel track;

a switching mechanism that realizes a branch line guide position at which the branch guide wheel of the one side is engaged with the branch line side guide rail and the branch guide wheel of the other side is unable to be engaged with the main line side guide rail, and a main line guide position at which the branch guide wheel of the other side is engaged with the main line side guide rail and the branch guide wheel of the one side is unable to be engaged with the branch line side guide rail;

a near side central guide rail which is the central guide rail of the near side main line travel track, and which is configured so that, at a traveling-direction near side with respect to a portion at which a central position of the far side main line travel track in a travel track width direction crosses the branch line travel track, and a traveling far side with respect to the branch starting position is set as a traveling far side end;

a far side central guide rail which is the central guide rail of the far side main line travel track, and which is configured so that a traveling far side with respect to a portion at which the central position of the far side main line travel track in the travel track width direction crosses the branch line travel track is set as a traveling near side end; and a branch line central guide rail which is the central guide rail of the branch line travel track, and which is configured so that a traveling far side with respect to a portion at which the central position of the branch line travel track in the travel track width direction crosses the far side main line travel track is set as a traveling near side end, wherein:

the track vehicle has the central guide wheels in each of the front and rear of the vehicle body; and both a distance dimension between the traveling far side end of the near side central guide rail and the traveling near side end of the far side central guide rail in a direction along the main line travel track, and a distance dimension between the traveling far side end of the near side central guide rail and the traveling near side end of the branch line central guide rail in a direction along the branch line travel track, are smaller than a distance dimension between the central guide wheels disposed in the front of the vehicle body and the central guide wheels disposed in the rear of the vehicle body.

* * * * *